US006859973B1

(12) United States Patent
Oranday

(10) Patent No.: US 6,859,973 B1
(45) Date of Patent: Mar. 1, 2005

(54) SQUEEGEE AND BRUSH HOLDER

(76) Inventor: Maximo E. Oranday, P.O. Box 951, Nocattee, FL (US) 34268

( * ) Notice: Subject to any disclaimer, the term of this patent is extended or adjusted under 35 U.S.C. 154(b) by 0 days.

(21) Appl. No.: 10/804,150

(22) Filed: Mar. 19, 2004

Related U.S. Application Data

(60) Provisional application No. 60/460,978, filed on Apr. 4, 2003.

(51) Int. Cl.[7] ..... A46B 17/02; B65D 90/12

(52) U.S. Cl. ..... 15/257.01; 15/246; 220/697; 220/700; 220/702; 248/110; 248/112; 248/213.2

(58) Field of Search ..... 15/246, 257.01; 220/697, 700, 701, 702; 248/213.2, 110, 111, 112, 113

(56) References Cited

U.S. PATENT DOCUMENTS 1,263,925 A * 4/1918 Polk ..... 211/65
2,748,977 A * 6/1956 Sarchet ..... 220/697
5,375,736 A * 12/1994 Gonzalez et al. ..... 220/697
6,622,978 B1 * 9/2003 Ghiz ..... 248/110
2002/0125385 A1 * 9/2002 Tweed ..... 248/213.2
2004/0173718 A1 * 9/2004 Song ..... 248/213.2

* cited by examiner

*Primary Examiner*—Randall Chin
(74) *Attorney, Agent, or Firm*—Frank A. Lukasik

(57) ABSTRACT

The instant invention pertains to a squeegee and brush holder in combination with a bucket for holding a liquid consisting of a first portion having a plurality of suction cups for adhering to the inside of the bucket and an outer portion having three openings, the outer portion extending outwardly from the bucket for holding the brushes and squeegees in an upright position.

3 Claims, 5 Drawing Sheets

10
11
12
13
14
15
16
17
18
19
30
A
B
C

SQUEEGEE AND BRUSH HOLDER

RELATED INVENTION

This application is a Continuation-In-Part of Provisional Application Ser. No. 60/460,978, Filed Apr. 4, 2003.

BACKGROUND OF THE INVENTION

1. Technical Field

The instant invention pertains generally to a window cleaning apparatus and more particularly to a device which may be used as a squeegee and brush holder mounted on a bucket or pail.

2. Background Art

Prior art devices suspend the cleaning tools within the bucket. This blocks access to the water or cleaning agent within the container. As will become apparent to those who have had the occasion to work with liquid applicators, no means is provided for conveniently supporting the applicator when not in use. Consequently, when the liquid applying operation is discontinued, and particularly temporarily so, there is no out-of-the-way but conveniently accessible place in which to put the applicator. This is particularly so in the window washing field where more than one type of applicator or tool is used. Prior art devices suspend the cleaning tools within the bucket. This blocks access to the water or cleaning agent within the container.

One such device is shown in U.S. Pat. No. 1,176,009 to Weimar which discloses a paint can attachment preferably made of wire and bent to form a plurality of outstanding loops collectively defining a rack for the reception of paint brushes, holding them within the can, allowing the paint to drip therein.

Another device is shown in U.S. Pat. No. 2,988,768 to Hill which discloses a support for a liquid applicator, namely paint, which is attached to the exterior of a paint bucket. A plurality of brackets are adapted to be fixedly secured to a band, the ends of which are urged together by a spring. The container may be provided with mounting brackets merely by slipping the band onto the side wall and the spring will retain the band in the proper position on the container.

SUMMARY OF THE INVENTION

The squeegee and brush holder of the invention consists of a bent wire or molded plastic hanger which is looped over the top edge of a bucket, and is secured to the interior of the bucket with suction cups mounted on the hanger.
the interior end is suspended inside the bucket and held in place by a plurality of suction cups. The exterior end is suspended down the outside of the bucket and extends outwardly. The squeegee and brush handles are inserted into the extended loops formed in the hanger in a staggered manner to provide space for handling up to four tool handles. The tools may be rapidly removed from the holder when desired.

It is therefore, a general object of this invention to provide a simple, relatively inexpensive and easily manufactured mounting structure to removably mount one or more window cleaning tools in a safe but conveniently accessible place out of the way of the user thereof.

Another object of the invention is to provide a mounting bracket structure which includes means for supporting the particular tool from the sidewall of the container.

DETAILED DESCRIPTION OF THE INVENTION

Figure 1:
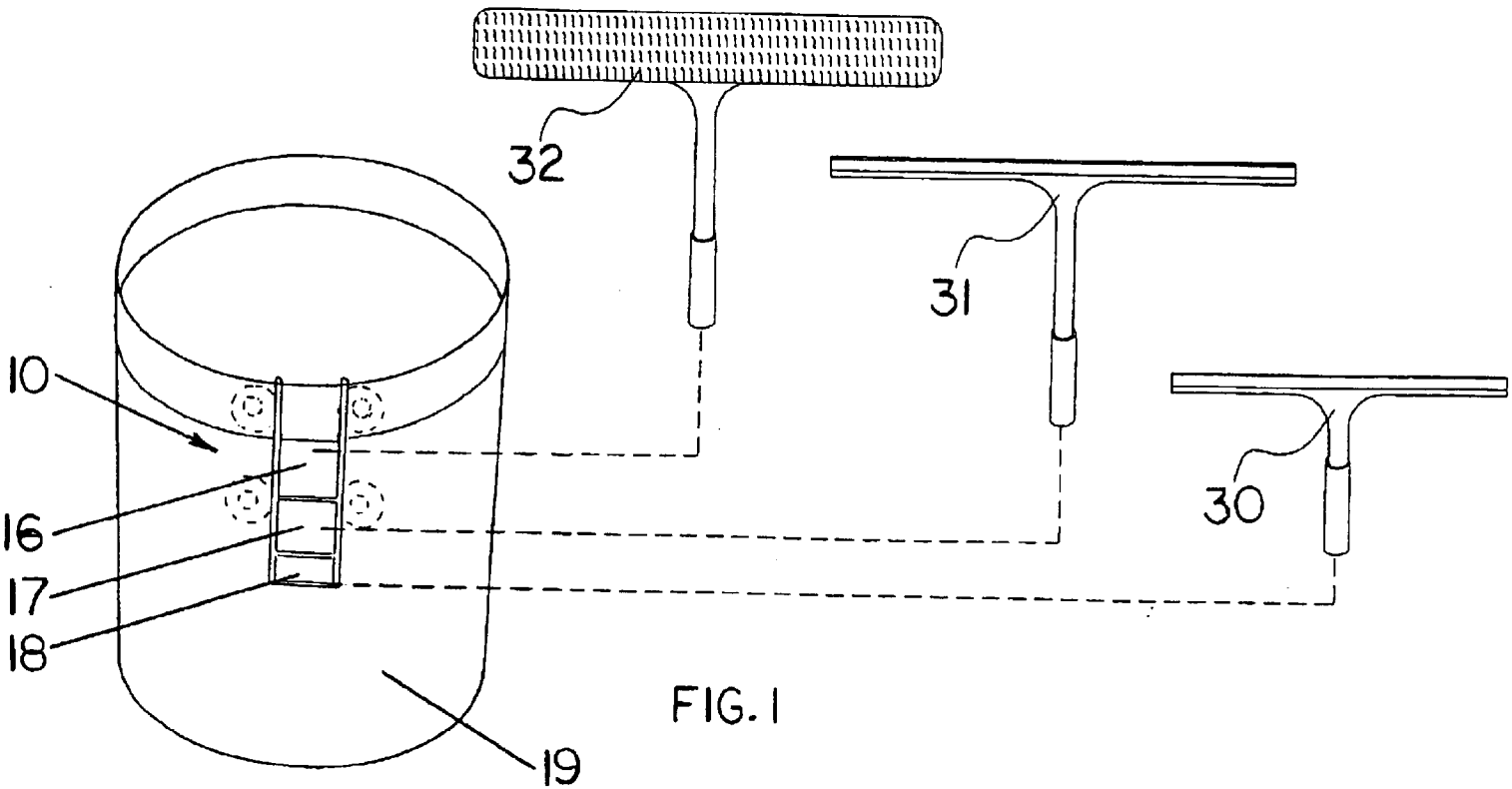
FIG. 1 is an exploded, perspective view of the invention showing the relationship of the invention and the tools.
Figure 1A:
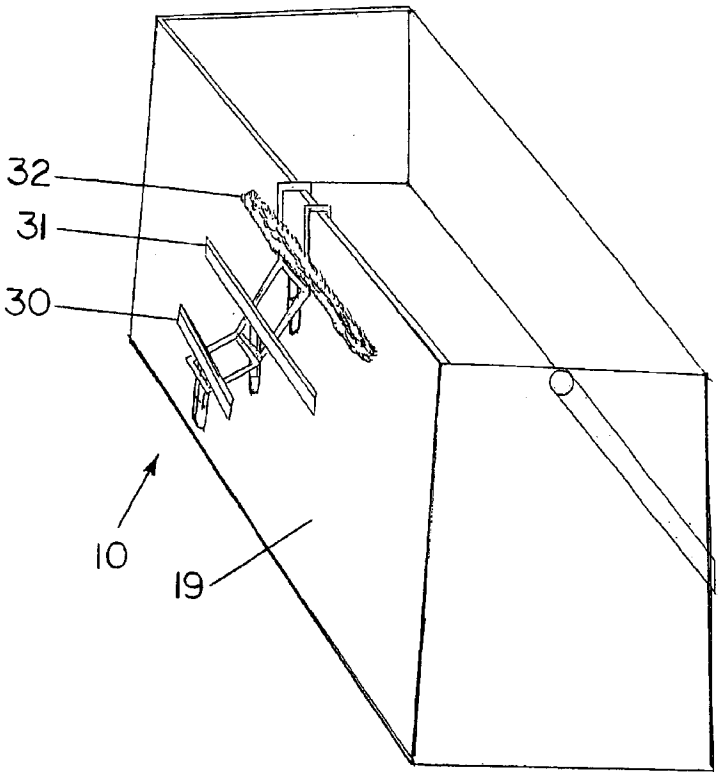
FIG. 1A is a perspective view of the invention showing the assembly of three tools held by the invention.

Referring to FIG. 1, there is shown the squeegee and brush holder of the invention generally designated by the numeral 10. The holder 10 is generally formed as a molded plastic hanger or a bent wire which is looped over the top edge of bucket 19 with a first portion 11 extending into the interior of bucket 19.

Figures 2, 2A, 2B, 2C:
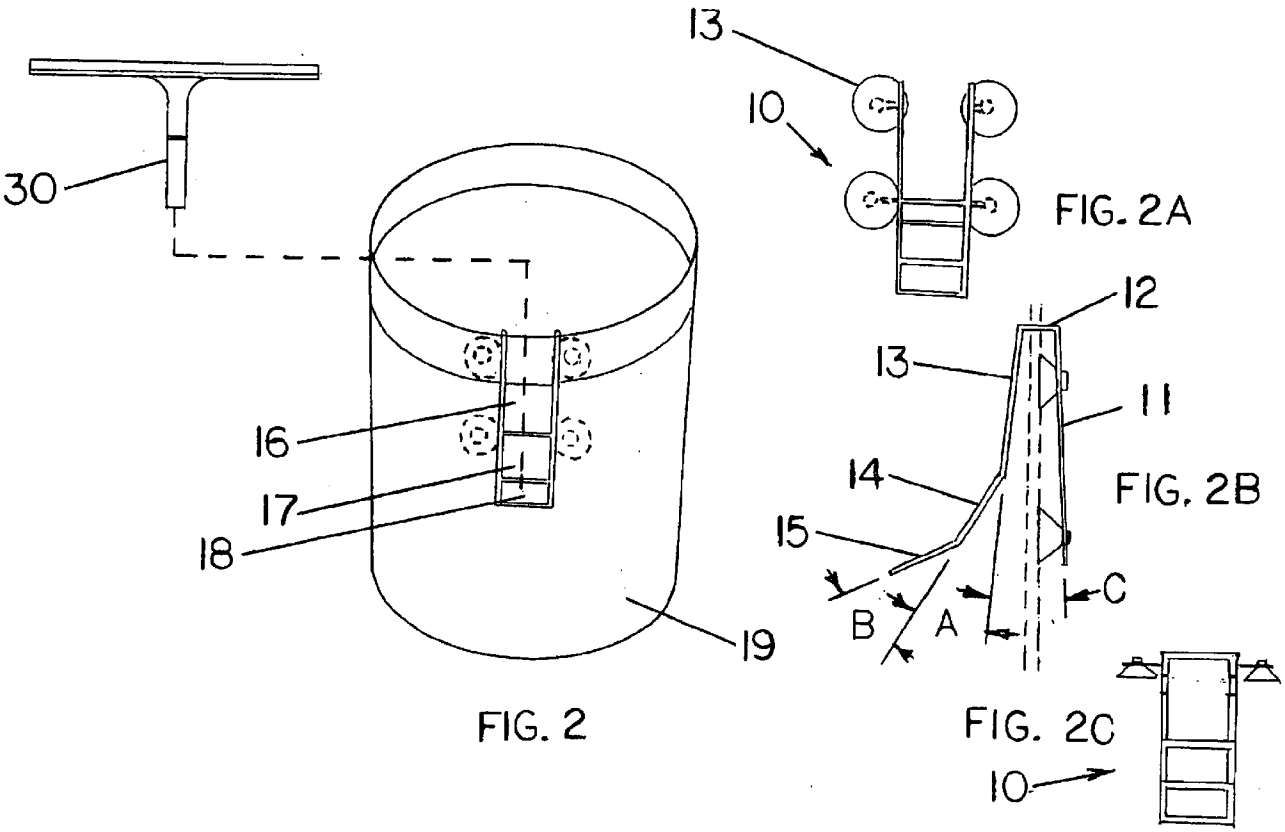
FIG. 2 is a perspective view showing a tool being mounted in the invention.
FIG. 2A is a front view of the invention.
FIG. 2B is a side view of the invention.
FIG. 2C is a top view of the invention.

As shown in FIGS. 2–2C, two suction cups 13 are fastened to the first portion 11 near the top end 12 and two suction cups 13 are fastened to a point located near the lower end of the first portion 11. The holder 10 includes an outer portion consisting of three loop portions 13, 14, and 15. Loop portion 14 is offset at angle "A", from loop portion 13, which is offset at angle "C" from the first portion 11. Loop portion 15 is offset at angle "B" from loop portion 14. Angles "A" and "B" and "C" are approximately 15° each.

FIG. 2 shows the resulting openings 16, 17, and 18 formed by the loop portions 13, 14, and 15.

Figure 3:
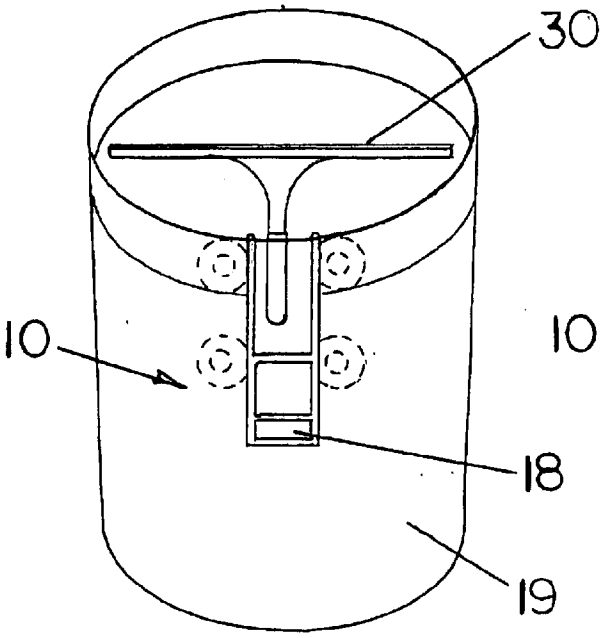
FIG. 3 is a perspective view of a single tool being inserted.

FIG. 3 shows a squeegee 30 prior to entry in the third opening 18.

Figure 5:
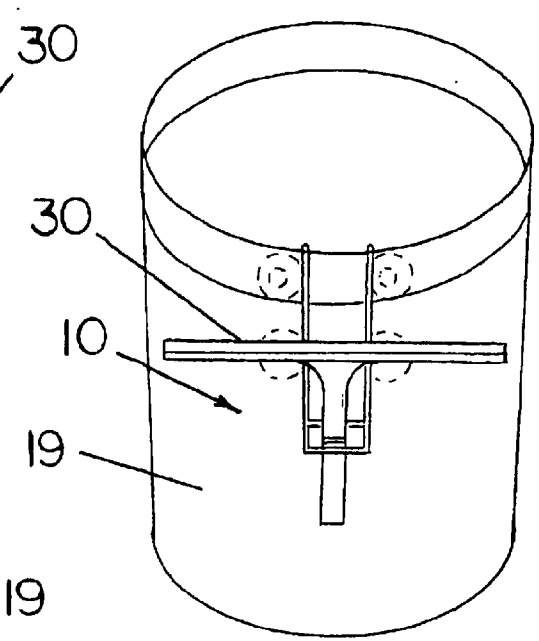
FIG. 5 is a perspective view of a single tool seated in the invention.
Figure 4:
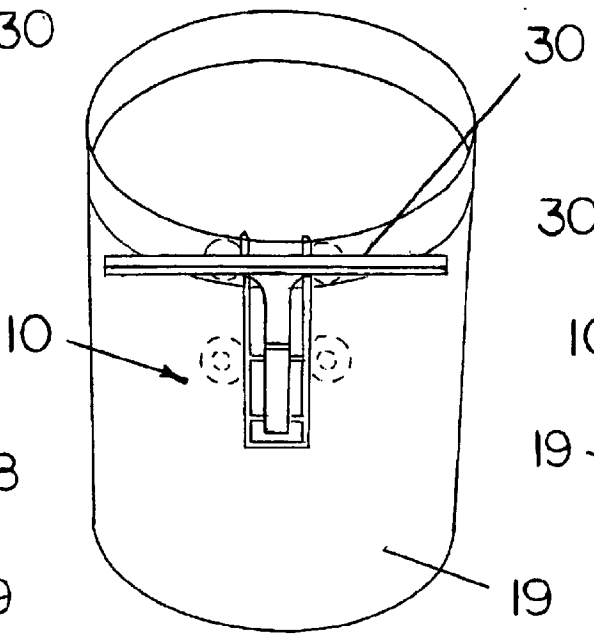
FIG. 4 is a perspective view of a single tool partially inserted in the invention.

FIGS. 3–5 show the squeegee 30 being inserted in the third loop 18.

Figure 7:
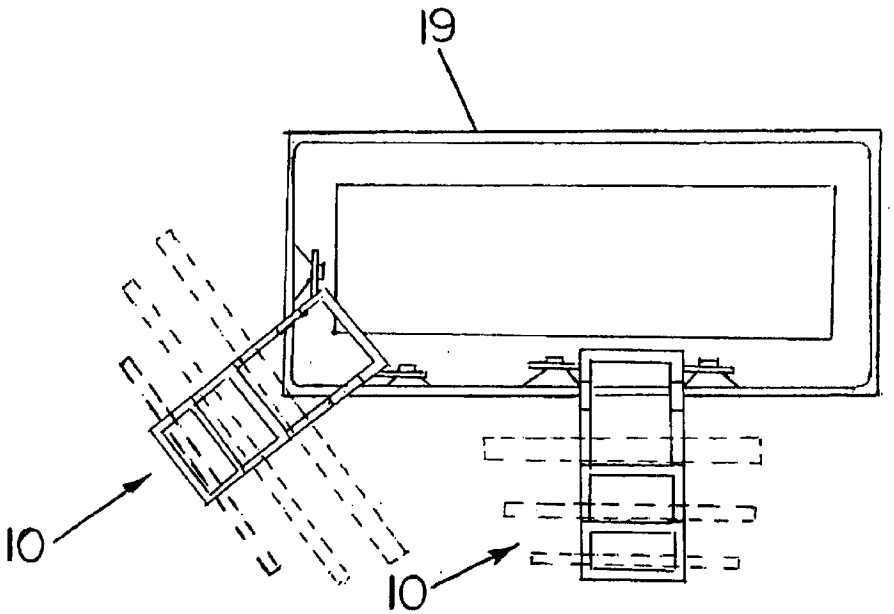
FIG. 7 is a top view of the invention mounted on a rectangular bucket.
Figure 6:
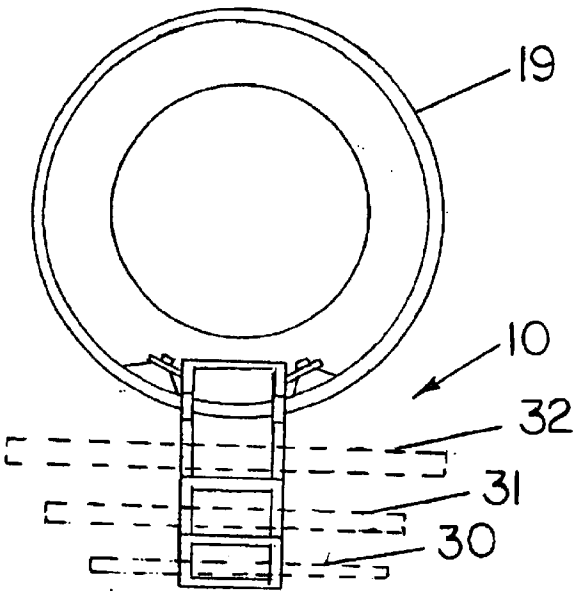
FIG. 6 is a top view of three tools mounted in the invention.

FIG. 6 is a top view of a circular bucket 19 having the holder 10 in accordance with the invention and three tools, a brush 32, a long squeegee 31, and a shorter squeegee 30 in position to be inserted into the openings 16, 17, and 18. FIG. 7 shows a holder 10 mounted in a corner and a holder 10 mounted on the side of a rectangular shaped bucket 19. The location of holder 10 in the corner of bucket 19 is the most convenient location.

In operation, the hanger 10 is mounted on the bucket 19 with the first portion 11 inserted in the bucket 19 with the top end 12 resting on the lip of the bucket 19. The four suction cups 13 are then pressed to form a grip on the inner surface of bucket 19. The brush 32 and squeegees 31 and 30 are then inserted in the openings 16, 17, and 18.

In a preferred embodiment, the holder 10 may be made by injection molding as a single unit. Another method would be to form the holder from ⅛" steel wire.

It will be obvious to a person skilled in the art to which this invention is addressed that the invention may be used to advantage in a variety of situations. Therefore, it is also understood by those skilled in the art that various changes, modifications and omissions in form and detail may be made without departing from the spirit and scope of the present invention as defined by the following claims.

What is claimed is:

1. A squeegee and brush holder in combination with a bucket for holding a liquid, said holder comprising a generally "U" shaped holder mounted on said bucket, said holder having:

a first portion extending into the interior of said bucket, said first portion having a plurality of suction cups mounted thereon, said suction cups being adhered to said bucket, a horizontal top end connected to said first portion, and an outer portion being connected to said top end, said outer portion having a first loop portion having an angle offset from said first portion, a second loop portion having an angle offset from said first loop portion, and a third loop portion having an angle offset from said second loop portion, each of said loop portions having an opening formed therein for extending outwardly from said bucket and holding the brushes and squeegees in an upright position.

2. A squeegee and brush holder in combination with a bucket for holding a liquid of claim 1 wherein said holder consists of molded plastic.

3. A squeegee and brush holder in combination with a bucket for holding a liquid of claim 1 wherein said holder consists of bent wire.

* * * * *